US005578438A

United States Patent [19]

Takada

[11] Patent Number: 5,578,438

[45] Date of Patent: Nov. 26, 1996

[54] SILVER HALIDE PHOTOGRAPHIC EMULSION AND SILVER HALIDE PHOTOGRAPHIC LIGHT-SENSITIVE MATERIAL

[75] Inventor: Hiroshi Takada, Hino, Japan

[73] Assignee: Konica Corporation, Tokyo, Japan

[21] Appl. No.: 404,507

[22] Filed: Mar. 15, 1995

[30] Foreign Application Priority Data

Mar. 17, 1994 [JP] Japan ..... 6-047241

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 5,096,806 | 3/1992 | Nakamura et al. | 430/567 |
| 5,206,134 | 4/1993 | Yamada et al. | 430/567 |
| 5,240,824 | 8/1993 | Takada et al. | 430/567 |
| 5,273,871 | 12/1993 | Takada et al. | 430/567 |
| 5,314,798 | 5/1994 | Brust et al. | 430/567 |
| 5,376,521 | 12/1994 | Inoue et al. | 430/567 |

*Primary Examiner*—Mark F. Huff

*Attorney, Agent, or Firm*—Frishauf, Holtz, Goodman, Langer & Chick, P.C.

[57] ABSTRACT

A silver halide emulsion is disclosed, comprising a dispersion medium and tabular silver halide grains having an aspect ratio of grain diameter to grain thickness of not less than 1.4, wherein the tabular grains each have a grain structure meeting the following requirement regarding iodide contents in the vicinity of grain surface, $$I_1 - I_2 \geqq 1 \text{ (mol \%)}$$

where $I_1$ and $I_2$ represent each an average silver iodide content in the region from the grain surface to a depth ($D_1$ and $D_2$) and $$D_1 = 1.1 \times [d_0^2 \pi (1/AR + 1/2)] + 13.4$$

$$D_2 = D_1 \times 2$$

wherein $d_O$ is an average diameter of said tabular grains and AR represents an average aspect ratio of said tabular grains. There is also disclosed a silver halide photographic material comprising a support having thereon a silver halide emulsion layer containing the tabular grains as characterized above.

10 Claims, No Drawings

SILVER HALIDE PHOTOGRAPHIC EMULSION AND SILVER HALIDE PHOTOGRAPHIC LIGHT-SENSITIVE MATERIAL

FIELD OF THE INVENTION

This invention relates to a silver halide photographic emulsion and a photographic light-sensitive material each high in sensitivity and excellent in preservability.

BACKGROUND OF THE INVENTION

In recent years, the needs for the characteristics of a silver halide light-sensitive material for photographic use have been more exacting. There have been higher level demands for the photographic characteristics such as sensitivity, fog and granularity and for the preservability. Recently, in particular, with the popularization of a compact zoom camera and a film attached with a camera mechanism that is so-called a camera with a lens, it has become inevitable for a photographic light-sensitive material to make a sensitization higher. Besides, a silver halide light-sensitive material has been preserved in various environments and used under various conditions. Therefore, the storage stability of photographic characteristics thereof have also strongly been required.

For satisfying the above-mentioned requirements, various techniques for improving a silver halide light-sensitive material have been developed. The highly sensitizing techniques applicable to a silver halide emulsion include, for example, those for an internally high iodide-containing core/shell type silver halide grain typified by a multiple-layer structured grain, such as those disclosed in Japanese Patent Publication Open to Public Inspection (hereinafter referred to as JP OPI Publication) No. 60-14331/1985. When silver iodide is contained in a silver halide grain, a photoelectron is inhibited from recombination by trapping a positive hole produced when the grain is made photosensitive, so that a latent-image forming efficiency can be improved. However, when increasing the silver iodide content, chemical sensitization nuclei produced by applying a chemical sensitization to the silver halide grain is dispersed, so that the latent-image forming efficiency may be lowered and, in addition, that the development activity of the silver halide grain may also be impaired. For solving the above-mentioned contradictory problems, the above-described technique intends to make compatible both of an efficient positive hole trapping function and a development activity by covering a core having a relatively high silver iodide content with a shell having a relatively low silver iodide content.

In an ordinary photographic light-sensitive material, a spectral sensitizing dye is adsorbed to the surface of the silver halide grain so as to give a spectral absorption property to the grain. However, when an adsorption of a spectral sensitizing dye to a silver halide grain is relatively weak, there may be some instances where a dye adsorbed to the surface of silver halide grains may be desorbed in the course of preserving the light-sensitive material, so that the sensitivity may be lowered; (this phenomenon may be remarkable particularly under the conditions of a high humidity and a high temperature.) Generally, the more a silver iodide content of the surface of a grain is increased, the more an adsorption of a sensitizing dye to a silver halide grain is also increased. It can, therefore, be expected that a preservability can be improved and a high sensitivity can also be obtained by increasing a silver iodide content of the surface of a silver halide grain.

As for a technique for intending the same as above, JP OPI Publication No. 5-75096/1993 discloses a silver halide photographic light-sensitive material comprising an internally high iodide-containing core/shell type silver halide grain having the surface portion where the silver iodide content is higher than that in the shell section and is also not less than 5 mol %. With the above-mentioned technique, however, it has been unable to solve such a problem that an initial developability is lowered and chemical sensitizing nuclei are dispersed. On the other hand, as a technique capable of realizing the improvement of a dye adsorbability and, at the same time, solving the problems of lowering a developability and dispersing chemical sensitizing nuclei, JP OPI Publication No. 3-237451/1991 discloses a silver halide photographic light-sensitive material comprising a silver halide grain comprising a portion ranged from an atomic layer constituting the uppermost surface of the grain to the fifth atomic layer, (for example, a section from the uppermost layer to the position of 14.4Å in the case of a cubic silver bromide grain), wherein the silver iodide content of the portion is relatively higher than that in the internal phase adjacent to the portion.

However, the demands for improving photographic characteristics have become more serious year by year, and a technique capable of realizing further progressed photographic characteristics has been requested.

SUMMARY OF THE INVENTION

By taking such a problem as mentioned above into consideration, it is an object of the invention to provide a silver halide photographic emulsion and a photographic light-sensitive material each capable of making a sensitivity more higher and improving an image quality and preservability.

The above-mentioned object of the invention can be achieved with a silver halide photographic emulsion containing a dispersion medium and a tabular-shaped silver halide grain having an aspect ratio of not less than 1.4, wherein in the neighborhood of the surface of the tabular-shaped grain, the grains have silver halide-compositional structure as below and a silver halide photographic light-sensitive material comprising a support coated thereon with a light-sensitive silver halide emulsion layer, wherein a silver halide photographic emulsion as above-mentioned is contained in said silver halide emulsion layer.

(Silver Halide Compositional Structure of Surface Layer)

For an average silver iodide content $I_1$ (in mol %) of a silver halide phase in a region from the uppermost surface of the grain to depth D1 (in Å) and an average silver iodide content, $I_2$ (in mol %) of a silver halide phase in a region from the uppermost surface of the grain to depth $D_2$ (in Å), a relation of $I_1-I_2 \leqq 1$ (in mol %) holds;

wherein $D_1=1.1\times[d_0^2\pi\ (1/AR+½)]+13.4$ $D_2=D_1\times 2$ $d_O$: An average diameter (in μm) of tabular-shaped silver halide grains having an aspect ratio of not less than 1.4.

AR: An average aspect ratio of tabular-shaped silver halide grains having an aspect ratio of not less than 1.4.

However, it has still been unable to clarify the mechanism in which a tabular-shaped silver halide grain having the above-mentioned Silver Halide Composition Structure of Surface Layer and an aspect ratio of not less than 1.4 can realize the effect to achieve the object of the invention.

DETAILED DESCRIPTION OF THE INVENTION

The term, 'a tabular-shaped silver halide grain' stated in this invention means a silver halide crystal having not less than two twinned planes therein. The classification of the twinned crystal configurations are detailed in, for example, Klein and Moiser, 'Photographishe Korrespondentz', Vol. 99, p. 99 and, ibid., Vol. 100, p. 57. The term, 'an aspect ratio' stated in this invention means a value obtained by dividing the diameter of a circle having the same area as the projected image area of a grain by the thickness of the grain. In this invention, the case of the expression, '-- contains a tabular-shaped silver halide grain having an aspect ratio of not lower than 1.4 --', means such a case where a total projected image area of silver halide grains corresponding to the tabular-shaped grains is not less than 60% of the total projected image area of silver halide grains contained in a silver halide emulsion.

In a silver halide phase localized in a outer region from the uppermost surface of a grain to a position of a depth $D_1$ or $D_2$ (in Å) stated in the invention, an average silver iodide content $I_1$ (in mol %) or $I_2$ (in mol %) of the silver halide phase can be obtained in, for example, an angular resolution XPS method (in which XPS stands for X-ray photoelectron spectroscopy), an ion-diffusion spectroscopy, and so forth.

When making use of an angular resolved XPS method, for example, $I_1$ and $I_2$ can be obtained in the following procedures.

With reference to the procedures described in 'A Macromolecule', Vol. 38, April Issue, p. 281, a single-layered aligned grain layer is prepared of a silver halide emulsion by coating it on a silicon substrate. After gelatin in the grain layer is decomposed and then removed away by making use of a proteinase solution, the grain layer is washed and then dried. The resulting silver halide composition in the grain surface area is measured in an angular resolution XPS method. For preventing the subject sample from being destroyed by an X-ray irradiation, the sample is kept at −120° C. and is then exposed to MgKα serving as a probing X-ray with an X-ray source voltage of 15 kV and an X-ray source current of 40 mA in a super-high vacuum condition of not higher than $1\times10^{-8}$ torr. The resulting electrons of Ag3d5/2, Br3d and I3d3/2 are each measured. The measured integral strength of the peak is compensated by a sensitivity factor. From the resulting strength ratios, the halide composition is obtained. When the depth from the surface of a sample, that can give 95% of the detected signal strength, is represented by D(Å), an average free-path of photoelectrons from element X is represented by λx(Å) and a take-off angle of the photoelectron is represented by θ, the following relation can be established.

$$D+3\cdot\lambda x\cdot\sin\theta$$

In the invention, by substituting $D_1$(Å) and $D_2$(Å) for the above-given relational expression and by making use of the average free-paths (Ag3d5/2=33.3Å, Br3d=38.6Å, $I_3$d3/2=28.1Å and C12p=36.5Å) of photoelectrons from each element, which can be obtained from the Seah-Dench rule of thumb, photoelectron take-off angles (θ) are each calculated out, and the silver iodide contents are measured by the take-off angles of photoelectrons (θ). The resulting silver iodide contents are regarded as the average silver iodide contents $I_1$ (in mol %) and $I_2$ (in mol %), respectively.

In the invention, it is an requirement for obtaining the effects of the invention that $I_1$ is to be greater than $I_2$ by 1 mol % or more. From the viewpoint of the greater effects to be obtained, $I_1-I_2\leqq2$ (mol %) is preferable, $I_1-I_2\leqq3$ (mol %) is more preferable, and $I_1-I_2\leqq5$ (mol %) is particularly preferable. $I_2$ is preferably $0\leqq I_2\leqq35$ (mol %), more preferably $0\leqq I_2\leqq30$ (mol %) and particularly $0\leqq I_2\leqq20$ (mol %).

A silver halide emulsion of the invention characterized in the silver halide composition structure on the surface layer thereof can be prepared, for example, by reacting an iodine-containing inorganic compound or an iodide-containing organic compound with a silver halide grain contained in an emulsion in at least one process selected from the group consisting of a silver halide emulsion preparation process (in other words, when forming a silver halide grain, and before, during and/or after carrying out a desairing-washing treatment after forming the grain), a silver halide emulsion sensitizing process (in other words, before, during and/or after carrying out a chemical sensitization or spectral sensitization of a silver halide emulsion) and a silver halide photographic light-sensitive material preparation process (in other words, before, during and/or after preparing a coating emulsion, before, during and/or after coating an emulsion, and before, during and/or after drying a coated layer).

In this case, in order to prevent the design specifications of the silver halide composition structure in the neighborhood of the surface layer from being shifted by an excessive recrystallization and so forth, it is preferable to keep the temperature inside a reaction vessel lower. To be more concrete, it is to be kept at a temperature preferably not higher than 75° C., more preferably not higher than 60° C. and, most preferably not higher than 40° C.

Prior to the reaction with an iodide-containing inorganic compound or an iodine-containing organic compound, the neighborhood of the surface of a silver halide grain is preferable to be formed by making use of a finely grained silver halide emulsion. The reason thereof is that, when making use of the above-mentioned method, a more accurate control can be performed on the silver halide composition structure in the neighborhood of the grain surface prior to the reacting process carried out with an iodide-containing inorganic compound or an iodide-containing organic compound. The grain-sizes of a finely grained silver halide emulsion applicable thereto are preferably not larger than 0.1 μm, more preferably 0.08 μm and, further preferably within the range of 0.01 to 0.06 μm.

Iodide-containing inorganic compounds applicable thereto include, for example, an aqueous sodium iodide solution, an aqueous potassium iodide solution, a silver iodide grain and a silver halide grain containing silver iodide. Those preferably applicable to more remarkably display the effects of the invention include, for example, a silver iodide and a silver halide grain containing silver iodide. The grain-sizes thereof is preferably not larger than 0.2μm, more preferably 0.1 μm and further preferably within the range of 0.01 to 0.08 μm. The above-mentioned iodide-containing organic compounds applicable thereto include, for example, a compound comprising iodide and such a monovalent organic residual group as is capable of releasing an iodide atom in the form of an iodide ion upon making reaction with a nucleophilic reagent or such a base as those of iodoethanol or iodoacetamidobenzene sulfonic acid.

The above-mentioned iodide-containing inorganic compounds and iodide-containing organic compounds may be used selectively in a suitable amount so as to be able to realize the silver halide composition structure of the surface layer of the invention, provided that the amounts thereof may be so varied as to meet the configurations of silver halide grains, the pAg/pH values of silver halide emulsions, and the processing steps to be applied. When making use of a silver iodide grain or a silver halide grain containing silver iodide as an iodide-containing inorganic compound, the less an iodide-containing inorganic compound remains without reacting with a silver halide grain contained in an emulsion, the more an excellent effect can be obtained.

There is no special limitation to the silver halide composition of a silver halide emulsion of the invention. However, silver iodobromide or silver chloroiodobromide is preferable. In this case, the average silver iodide content thereof is preferably not less than 1 mol %, more preferably not less than 2 mol % and further preferably not less than 3 mol %. If an average silver iodide content exceeds not less than 20 mol %, the effects of the invention cannot be obtained, because the developability of the grain is seriously impaired. When containing silver chloride, the average molar fraction thereof is preferably not higher than 10 mol % and more preferably not higher than 5 mol %.

In the invention, the average value of an aspect ratio (AR) of tabular-shaped silver halide grains is preferably $1.4 \leqq AR \leqq 15$, more preferably $2.0 \leqq AR \leqq 10$ and further preferably $2 \leqq AR \leqq 6$, wherein the average aspect ratio is herein defined to be the average grain diameter divided by the average grain thickness. Among the tabular-shaped silver halide grains contained in a silver halide emulsion of the invention, it is preferable that preferably not less than 60%, more preferably not less than 70% and most preferably not less than 80% thereof by number be those each having two parallel twin planes. The numbers of the twin planes of a tabular-shaped grain can be observed through a transmission type electron microscope. The concrete observation method is as follows.

First, a sample is prepared by coating a silver halide emulsion on a support so that a tabular-shaped silver halide grain to be contained in the emulsion may be so aligned as to make the principal plane face thereof almost parallel to the support. The resulting sample is shaved to be a thinly cut piece having a thickness of the order of 0.1 μm by making use of a diamond-cutter. When observing the resulting cut piece through a transmission type electron microscope, the presence of the twinned crystal faces and the numbers thereof can be confirmed.

It is allowed that a silver halide photographic emulsion of the invention may contain those having a regular crystal form such as a cube, an octahedron and a tetradecahedron, those having a globular-shape, those having an irregularly crystallized configuration such as a potato-shape, and a nonparallel twinned crystal grain; besides the above-mentioned tabular-shaped grains having an aspect ratio of not lower than 1.4. With silver halide grains contained in a silver halide emulsion of the invention, the average grain-sizes (i.e., diameters) thereof are to be within the range of, preferably, not 0.1 μm to 10 μm, more preferably, 0.1 μm to 5 μm and, most preferably, 0.2 μm to 3 μm. The term, 'a grain-size', stated herein means a diameter of a circle having an area equal to the projected area of the grain. The term, 'an average grain-size', is hereby defined as a grain-size obtained when a product of a frequency ni (number) of grains having a grain-size ri and $ri^3$ ($ni \times 2ri^3$) becomes a maximum. The measurement thereof is to be made on not less than 1000 grains selected at random, in which the significant figure is in three columns and the figure in the lowest column is rounded to the nearest whole number. A grain-size ri can be obtained in the following manner; a subject silver halide grain is magnified 10,000 to 70,000 times and is then photographed through an electron microscope and, on the print of the grain, the diameter or projected area thereof is practically measured.

For a silver halide photographic emulsion of the invention, it is allowed to make use any desired emulsions such as a polydisperse type emulsion having a relatively wide grain-size distribution and a monodisperse type emulsion having a relatively narrow grain-size distribution. However, a monodisperse type emulsion is preferred. A monodisperse type emulsion means those having a grain-size distribution width of not higher than 20%, provided that the grain-size distribution width is defined by a value (%) obtained by multiplying, by 100, a value obtained by dividing the standard deviation of grain-size by an average grain-size. An average grain-size and standard deviation are to be obtained from the above-defined grain-size ri.

One of the preferable embodiments of the invention is a grain having such a structure that there are a high silver iodide content phase (i.e., a high iodide phase) and a low silver iodide content phase (i.e., a low iodide phase) each in the grain. In this case, the silver iodide content of a high iodine phase is preferably not lower than 5 mol %, more preferably within the range of 8 to 45 mol % and, particularly within the range of 10 to 40 mol %. The volume thereof is to be set within the range of, preferably 10 to 80 mol % of the whole grain, more preferably 15 to 60 mol % and further preferably 15 to 45 mol %. Between the silver iodide content of the high iodine phase and that of the low iodide phase, there is to be a difference of, preferably not less than 5 mol % and more preferably not less than 10 mol %.

There is no special limitation to the positions relative to and between the high iodide phase and the low iodide phase. In other words, it is allowed that the high iodide phase is localized in a internal portion within the grain and the low iodide phase is in a outer portion thereof, and it is also allowed to reverse the case. However, it is preferable that at least one low iodide phase is located outside the high iodide phase.

It is also allowed to have the other silver iodide content phase (or an intermedium phase) localized between a high iodide phase and a low iodide phase. In this case, the intermedium phase is preferable to have a silver iodide content lower than that of a high iodide phase but higher than that of a low iodide phase. The volume of the interphase is advisable to be within the range of 5 to 70% of the whole grain and preferably 10 to 65%. In this case, it is further allowed that a further silver halide layer may be made present between the high iodide phase and the intermedium phase, or between the intermedium phase and the low iodide phase.

It is preferable that an emulsion of the invention is spectrally sensitized by a sensitizing dye. A spectrally sensitizing dye applicable thereto includes, for example, a merocyanine dye and a cyanine dye. A cyanine dye preferably applicable thereto includes, for example, that given in JP OPI Publication No. 3-219232/1991. The above-mentioned sensitizing dyes may be used independently or in combination. It is also allowed to use them with the other sensitizing dyes or a super sensitizer in combination. The methods for adding a sensitizing dye to an emulsion include, for example, a method of directly dispersing the sensitizing dyes to an emulsion, and another method in which a sensitizing dye id dissolved in a water-soluble solvent such as methanol, fluorinated alcohol or the mixture thereof, and the resulting solution is then added to the subject emulsion. Besides the above, the following methods may also be used. A method in which a sensitizing dye is dissolved in a volatile organic solvent and the resulting solution is dispersed in a hydrophilic colloid, then, the resulting dispersion is added to an emulsion, as described in U.S. Pat. No. 3,469,987; or another method in which a water-insoluble dye is dispersed in a water-soluble solvent without dissolving the dye, and the resulting dispersed solution is then added to an emulsion, as described in JP Examined Publication No. 46-24185/1971.

In the invention, as for silver halide grains which may be contained in silver halide emulsions and silver halide photographic light-sensitive materials each of the invention, those described in Research Disclosure No. 308119 (hereinafter abbreviated to RD308119) may be used. The pages described thereof will be shown below.

| (Item) | (Page) |
|---|---|
| Iodide composition | 993 I-A |
| Preparation | 993 I-A & 994 E |
| Crystal habit | |
| Regular crystal | 993 I-A |
| Twinned crystal | 933 I-A |
| Epitaxial | 933 I-A |
| Halide composition | |
| Uniform composition | 993 I-B |
| Ununiform composition | 933 I-B |
| Halide conversion | 994 I-C |
| Halide substitution | 994 I-C |
| Metal content | 994 I-D |
| Monodispersion | 995 I-F |
| Solvent addition | 995 I-F |
| Latent image forming position | |
| Surface | 995 I-G |
| Interior | 995 I-G |
| Light-sensitive materials to be applicable | |
| Negative | 995 I-H |
| Positive (incl. an internally fogged grain type) | 995 I-H |
| Emulsion blend | 995 I-J |
| Desalting | 995 II-A |

In the invention, a silver halide emulsion is to be used after it was physically ripened, chemically ripened and spectrally sensitized. The additives applicable in such a process as mentioned above are given in Research Disclosure Nos. 17643, 18716 and 308119, (hereinafter abbreviated to RD17643, RD18716 and RD308119, respectively.) The pages described thereof will be shown below.

| (Item) | Pages of (RD308119) | (RD17643) | (RD18716) |
|---|---|---|---|
| Chemical sensitizer | 996 III-A | 23 | 648 |
| Spectral sensitizer | 996 IV-A-A,B,C,D,E, H,I,J | 23–24 | 648–9 |
| Super-sensitizer | 996 IV-A-E,J | 23–24 | 648–9 |
| Antifoggant | 998 VI | 24–25 | 649 |
| Stabilizer | 998 VI | 24–25 | 649 |

The well-known photographic additives applicable to the invention are also given in the above-mentioned Research Disclosure. The pages described thereof will be shown below.

| (Item) | Pages of (RD308119) | (RD17643) | (RD18716) |
|---|---|---|---|
| Color-stain preventive | 1002 VII-I | 25 | 650 |

-continued

| (Item) | Pages of (RD308119) | (RD17643) | (RD18716) |
|---|---|---|---|
| Dye-image stabilizer | 1001 VII-J | 25 | |
| Whitening agent | 998 V | 24 | |
| UV absorbent | 1003 VIII C, XIII C | 25–26 | |
| Light absorbent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant/ Coating aid | 1005 XI | 26-27 | 650 |
| Matting agent | 1007 X VI | | |
| Developing agent (contained in a light-sensitive material) | 1011 XX-B | | |

In the invention, a variety of couplers can be used. The concrete examples thereof are given in the above-mentioned Research Disclosures. The pages related thereto will be shown below.

| (Item) | Pages of (RD308119) | (RD17643) | (RD18716) |
|---|---|---|---|
| Yellow coupler | 1001 VII-D | VII C-G | |
| Magenta coupler | 1001 VII-D | VII C-G | |
| Cyan coupler | 1001 VII-D | VII C-G | |
| Colored coupler | 1002 VII-G | VII G | |
| DIR coupler | 1001 VII-F | VII F | |
| BAR coupler | 1002 VII-F | | |
| Other useful group-releasing couplers | 1001 VII-F | | |
| Alkali-soluble coupler | 1001 VII-E | | |

The additives applicable to the invention may be added in such a dispersion process as described in RD308119 XIV.

In the invention, the supports described in the foregoing RD17643, p. 28, RD18716, p. 647-8, and RD308119, XIX may be used.

To a light-sensitive material of the invention, auxiliary layers such as a filter layer and an intermediate layer each described in the foregoing RD308119 VII-K may be provided.

A light-sensitive material of the invention may have various layer arrangements such as an ordinary layer order, an inverse layer order and a unit layer structure each described in the foregoing RD308119 VII-K.

This invention can be applied to a variety of color light-sensitive materials typified by a color negative film for general or movie use, a color reversal film for slide or TV use, and a color positive film. A light-sensitive material of the invention can be developed in such an ordinary process as described in the foregoing RD17643, pp. 28–29, RD18716, p. 615 and RD308119, XIX.

EXAMPLES

Now, the invention will concretely be detailed by citing the following examples. However, the invention shall not be limited thereto.

EXAMPLE 1

(Preparation of seed emulsion T-1 having two parallel twinned planes)

With reference to the descriptions in JP Application No. 3-341164/1991, seed emulsion (T-1) having two parallel twinned crystal faces was prepared in the following procedures.

| | |
|---|---|
| Solution A | |
| Ossein gelatin | 80.0 g |
| Potassium bromide | 47.4 g |
| A 10 wt % methanol solution of Compound I (*) | 0.35 ml |
| Add water to make | 8000 ml |
| Solution B | |
| Silver nitrate | 1200 g |
| Add water to make | 1600 ml |
| Solution C | |
| Ossein gelatin | 32.2 g |
| Potassium bromide | 790 g |
| Add water to make | 1600 ml |
| Solution D | |
| Aqueous ammonia | 470 ml |

* Compound I: $HO(CH_2CH_2O)_m[CH(CH_3)CH_2O]_{19.8}(CH_2CH_2O)_nH$ (m + n = 9.77)

By making use of a stirrer described in JP OPI Publication No. 62-160128/1987, solution A was violently stirred at 40° C. and, thereto, solutions B and C were added by taking 9.2 minutes in a double-jet method, so that a nucleus formation could be performed. In the courses mentioned above, the pBr thereof was kept at 1.60. After that, the temperature was lowered down to 20° C. by taking 35 minutes. Solution D was further added for one minutes and, successively, a ripening treatment was carried out for 5 minutes. In the course of carrying out the ripening treatment, the concentration of KBr and ammonia were 0.03 mols/liter and 0.66 mols/liter, respectively.

After completing the ripening treatment, the pH was adjusted to be 6.0 and then a desairing treatment was carried out in an ordinary manner. When the resulting seed emulsion grains were observed through an electron microscope in the aforementioned method, the average grain-size of the seed grains was proved to be 0.225μm and the two parallel twinned planes were proved to account for 86% by number of the whole grains. (Preparation of control emulsion Em-1)

By making use of the following five kinds of solutions, a comparative emulsion (Em-1) containing core/shell type tabular-shaped silver halide grains was prepared.

| | |
|---|---|
| Solution A-1 | |
| Ossein gelatin | 66.5 g |
| Distilled water | 3227 ml |
| A 10 wt % methanol solution of Compound I | 2.50 ml |
| Seed emulsion (T-1) | 0.201 mols |
| Add distilled water to make | 6000 ml |
| Solution B-1 | |
| An aqueous 3.5N silver nitrate solution | 16.45 mols |
| Solution C-1 | |
| An aqueous 3.5N potassium bromide solution | 16.45 mols |
| Solution D-1 | |
| A finely grained emulsion comprising 3.0 wt % of gelatin and silver iodide grains (having an average grain-size of 0.05 μm) | 1.01 mols |

The preparation procedures thereof will be shown below. Two thousand (2000) ml each of an aqueous solution containing 7.06 mols of silver nitrate and an aqueous solution containing 7.06 mols of potassium iodide were added to 5000 ml of a solution containing 0.06 mols of potassium iodide and 6.0wt % of gelatin, by taking 10 minutes. In the course of forming the fine grains, the temperature was controlled to be 40° C. The resulting finished weight was 12.53 kg.

Solution E-1

An aqueous 3.5N potassium bromide solution in an amount needed

A core-/shell type silver halide emulsion was prepared in the following procedures. Solution A-1 was put in a reaction vessel and, while violently stirring it, Solutions B-1 through D-1 were added thereto in a double-jet method, in accordance with the combination shown in Table 1, so as to grow up the seed crystals.

In the course of the preparation, (1) the adding rates of Solutions B-1, C-1 and D-1 and (2) the adding rates of Solutions B-1 and C-1 were each varied acceleratedly so as to meet the critical growth rate of the silver halide grains. Thereby, the adding rates were suitably controlled so as neither to produce any other small grains than the growing seed crystals nor to produce any polydispersion caused by an Ostwald ripening phenomenon. Extending over the whole process of growing the crystals, the temperature and pAg of the solution in the reaction vessel were controlled to be 75° C. and 8.8 to 9.4, respectively. Whenever occasion required, Solution E-1 was added to control the pAg. No pH control was carried out. However, it was kept within the range of pH5.0 to 6.0 all the while the grains were growing. The silver salt amounts added and the silver iodide contents of the silver halide phases being formed each at every point of time when adding the solutions will also be shown in Table 1.

After the grains were grown up, a desalting treatment was carried out in the procedures described in JP Application No. 3-41314/1991 and 1.19 liters of an aqueous 20wt % gelatin solution was then added. The pH and pBr of the resulting solution were adjusted to be pH 5.80 and pBr 3.55 at 50° C., respectively. The silver halide grains contained in the resulting silver halide emulsion were proved to be monodisperse type tabular-shaped silver halide grains having $d_0$=1.69 μm, an average aspect ratio of 3.8 and a grain-size distribution of 16%.

TABLE 1

| Solution added | Time of adding solutions (in min) | Silver salt amount added (in %) | Silver iodide content (in mol %) |
|---|---|---|---|
| (1) B-1, C-1, D-1 | 0.00 | 0.0 | 10.0 |
| (1) B-1, C-1, D-1 | 30.99 | 3.0 | 10.0 |
| (1) B-1, C-1, D-1 | 52.47 | 6.0 | 10.0 |
| (1) B-1, C-1, D-1 | 76.48 | 10.0 | 10.0 |
| (1) B-1, C-1, D-1 | 76.48 | 10.0 | 30.0 |
| (1) B-1, C-1, D-1 | 117.30 | 18.0 | 30.0 |
| (1) B-1, C-1, D-1 | 150.13 | 25.0 | 30.0 |
| (1) B-1, C-1, D-1 | 150.13 | 25.0 | 10.0 |
| (1) B-1, C-1, D-1 | 176.09 | 31.0 | 10.0 |
| (2) B-1, C-1 | 176.09 | 31.0 | 0.0 |
| (2) B-1, C-1 | 209.51 | 50.0 | 0.0 |
| (2) B-1, C-1 | 221.07 | 64.0 | 0.0 |
| (2) B-1, C-1 | 230.68 | 80.0 | 0.0 |
| (2) B-1, C-1 | 239.00 | 100.0 | 0.0 |

(Preparation of Emulsions Em-2 and 4)

Emulsions (Em-2) through (Em-4) were each prepared in the same manner as in the preparation of Control Emulsion Em-1, except that an aqueous 5% potassium iodide solution was added after growing the grains and before carrying out a desalting treatment and a ripening treatment was carried out for 5 minutes. In Emulsions (Em-2) through (Em-4), the aqueous potassium iodide solutions were each added in an amount different from each other.

(Preparation of Control Emulsion Em-5)

Control Emulsion (Em-5) was prepared in the same manner as in Control Emulsion (Em-1), except that Solutions B-1 and C-1 were each completely added at the point of time when 93.6% of the silver salt was added; that Solution H-1 was successively added in an amount of 0.9 mols by taking 12 minutes and, further, the resulting mixture was stirred for 10 minutes; a desalting treatment was carried out thereafter in the method described in JP Application No. 3-41314/1991 and 1.19 liters of an aqueous 20 wt % gelatin solution was added; that, after dispersing the resulting mixture for 15 minutes, the pBr thereof was adjusted to be 1.5 at 50° C. by making use of an aqueous 3.5N potassium bromide solution and the following Solution H-1 was then added in an amount of 0.21 mols by taking 30 seconds; and that, after stirring the resulting mixture for 20 minutes successively, the pH and pBr thereof were adjusted at 40° C. to be 5.80 and 3.55, respectively.

| Solution H-1 | |
|---|---|
| A finely grained emulsion comprising gelatin (3 wt %) and silver bromide grains (an average grain-size of 0.04 μm) | 1.11 mols |

The preparation procedures thereof will now be detailed.

Two thousand (2000) milli-liters each of an aqueous solution containing 7.06 mols of silver nitrate and an aqueous solution containing 7.06 mols of potassium iodide were added to 5000 ml of a solution containing 0.06 mols of potassium iodide and 6.0 wt % of gelatin, by taking 10 minutes. In the course of forming the fine grains, the temperature was controlled to be 30° C. and the pH thereof was adjusted to be 3.0 with nitric acid. After forming the fine grains, the pH thereof was adjusted to be 6.0 with an aqueous sodium carbonate solution.

(Preparation of Emulsions Em-6 through Em-8)

Emulsions Em-6 through Em-8 were each prepared in the same manner as in Control Emulsion Em-5, except that Solution H-1 was added in an amount of 0.21 mols and the mixture was stirred for 20 minutes; that Solution D-1 was successively added and the mixture was ripened for 15 minutes; and, thereafter, the pH and pBr thereof were adjusted at 40° C. to be 5.80 and 3.55, respectively. In Emulsions (Em-6) through (Em-8), the solutions D-1 were added respectively in an amount different from each other.

(Preparation of Control Emulsion Em-9)

An octahedral, twinned crystal, monodisperse type emulsion Em-9 was prepared by making use of the following 7 kinds of solutions.

| Solution A-2 | |
|---|---|
| Ossein gelatin | 268.2 g |
| Distilled water | 4000 ml |
| A 10% methanol solution of Compound I | 1.5 ml |
| Seed emulsion (T-1) | 0.201 mols |
| An aqueous 28 wt % ammonia | 528 ml |
| An aqueous 56 wt % acetic acid solution | 795 ml |
| A methanol solution containing 0.001 mols of iodine | 50 ml |
| Add distilled water to make | 5930 ml |
| Solution B-2 | |
| An aqueous 3.5N silver nitrate solution (of which the pH was adjusted to be 9.0 with ammonium nitrate) | 15.34 mols |
| Solution C-2 | |
| An aqueous 3.5N potassium bromide solution containing 4.0 wt % of gelatin | 15.34 mols |
| Solution D-2 | |
| A finely grained emulsion comprising 3 wt % of gelatin and silver iodide grains (having an average grain-size of 0.05 μm) The preparation procedures were the same as those of Solution D-1. | 1.01 mols |
| Solution H-2 | |
| A finely grained emulsion comprising 3 wt % of gelatin and silver iodide grains (having an average grain-size of 0.04 μm) | 1.11 mols |

The preparation procedures were the same as those of Solution H-1.

Solution F-2

An aqueous 3.5N sodium bromide solution

Solution -2

An aqueous 56 wt % acetic acid solution

After adding Solutions B-2, C-2 and D-2 to Solution A-2 that was being kept at 70° C. in a reaction vessel in a double-jet method by taking 160 minutes, Solution H-2 was added thereto independently at a constant rate by taking 12 minutes, so that seed crystals could be grown up. The adding rates of Solutions B-2 and C-2 were varied acceleratedly so as to meet the critical growth rate of the silver halide grains, respectively. Thereby, the adding rates were suitably controlled so as neither to produce any other small grains than the growing seed crystals nor to produce any polydispersion caused by an Ostwald ripening phenomenon. In the course of supplying Solution D-2. i.e., a finely grained silver iodide emulsion, the ratio of the adding rate thereof to that of an aqueous ammoniacal silver nitrate solution (molar ratio) was varied as shown in Table 2. Thereby, a core/shell type silver halide emulsion having a multiple structure could be prepared. By making use of Solutions F-1 and G-1, the pAg and pH thereof were controlled in the course of growing the crystals, as shown in Table 2. The measurements of the pAg and pH thereof were carried out in the ordinary manner by making use of silver sulfide electrodes and glass electrodes.

After growing the grains up, a desalting treatment was carried out in the method described in JP Application No. 3-41314/1991. After gelatin was added, a redispersion treatment was carried out and the pH and pBr thereof were adjusted at 40° C. to be 5.80 and 8.05, respectively. From the scanning type electron microscopic photograph of the resulting emulsion grains, the resulting emulsion was proved to be an octahedral, twinned crystal, monodisperse type emulsion having an average cubewise converted grain-size of 1.0μm and grain-size distribution of 10.6%.

TABLE 2

| Solution added | Time of adding solutions (in min) | Silver amount added (in %) | Silver iodide content (in mol %) | pH | pAg |
|---|---|---|---|---|---|
| (1) B-2, C-1, D-2 | 0.00 | 0.0 | 10.0 | 7.2 | 7.8 |
| (1) B-2, C-1, D-2 | 21.14 | 3.0 | 10.0 | 7.2 | 7.8 |
| (1) B-2, C-1, D-2 | 35.78 | 6.0 | 10.0 | 7.2 | 7.8 |
| (1) B-2, C-1, D-2 | 52.16 | 10.0 | 10.0 | 7.2 | 7.8 |
| (1) B-2, C-1, D-2 | 52.16 | 10.0 | 30.0 | 7.2 | 7.8 |
| (1) B-2, C-1, D-2 | 80.56 | 18.0 | 30.0 | 7.2 | 7.8 |
| (1) B-2, C-1, D-2 | 102.39 | 25.0 | 30.0 | 6.5 | 9.4 |
| (1) B-2, C-1, D-2 | 102.35 | 25.0 | 10.0 | 6.5 | 9.4 |
| (1) B-2, C-1, D-2 | 120.10 | 31.0 | 10.0 | 6.5 | 9.4 |
| (2) B-2, C-2 | 120.09 | 31.0 | 0.0 | 6.5 | 9.4 |
| (2) B-2, C-2 | 142.85 | 50.0 | 0.0 | 6.5 | 9.4 |
| (2) B-2, C-2 | 150.27 | 64.0 | 0.0 | 6.5 | 9.4 |

TABLE 2-continued

| Solution added | Time of adding solutions (in min) | Silver amount added (in %) | Silver iodide content (in mol %) | pH | pAg |
|---|---|---|---|---|---|
| (2) B-2, C-2 | 160.00 | 93.6 | 0.0 | 6.5 | 9.7 |
| H-2 | 160.00 | 93.6 | 0.0 | 6.5 | 9.7 |
| H-2 | 172.00 | 100.0 | 0.0 | 6.5 | 9.7 |

(Preparation of Emulsion Em-10 & Em-11)

Emulsions (Em-10) and (Em-11) were each prepared in the same manner as in the preparation of Control Emulsion Em-9, except that Solution D-2 was added after growing the grains and prior to a desalting treatment, and ripening was carried out for 15 minutes. To each of Emulsions (Em-10) and (Em-11), Solution D-2 was added in an amount different from each other. Emulsions (Em-10) and (Em-11) prepared in the above-mentioned manner were measured to obtain the values of $I_1$ and $I_2$ in the foregoing angular resolved XPS method. The values thereof obtained will be shown in Table 3.

TABLE 3

| Emulsion | Configuration | $I_1$ (mol %) | $I_2$ (mol %) | $I_1$–$I_2$ (mol %) | Classification |
|---|---|---|---|---|---|
| Em-1 | Tabular | 2.1 | 1.9 | 0.2 | Comparison (Control) |
| Em-2 | Tabular | 3.6 | 2.3 | 1.3 | Invention |
| Em-3 | Tabular | 7.5 | 5.8 | 1.7 | Invention |
| Em-4 | Tabular | 18.2 | 17.9 | 0.3 | Comparison |
| Em-5 | Tabular | 0.6 | 0.7 | −0.1 | Comparison (Control) |
| Em-6 | Tabular | 6.8 | 1.2 | 5.6 | Invention |
| Em-7 | Tabular | 10.4 | 6.1 | 4.3 | Invention |
| Em-8 | Tabular | 17.3 | 6.5 | 0.8 | Comparison |
| Em-9 | Octahedral | 0.9 | 0.8 | 0.1 | Comparison (Control) |
| Em-10 | Octahedral | 5.9 | 2.6 | 3.3 | Comparison |
| Em-11 | Octahedral | 9.1 | 7.4 | 1.7 | Comparison |

Emulsions (Em-1) through (Em-11) were each subjected to an optimum chemical and spectral sensitization. On the other hand, Em-12 through Em-14 were each prepared by adding solution D-1 in the course of the same sensitization process as in the case of Em-5 and in the same amount as the amount thereof added after forming the grains in the process for preparing Em-6 through Em-8. The $I_1$ and $I_2$ values of Em-12 through Em-14 well coincided with those of Em-6 through Em-8. The resulting Em-1 through Em-14 were each used in the portions denoted by (Emulsion A) in the following sample preparation formulas, so that Sample-1 through Sample-14 could be prepared.

On a triacetyl cellulose film support, the layers having the following composition were formed in the order from the support side, so that multilayered color photographic light-sensitive material samples could be prepared.

An amount added is herein indicated in terms of grams per $m^2$ unless otherwise expressly stated. A silver halide and colloidal silver are each indicated in terms of an amount converted into an amount of silver corresponding thereto. A sensitizing dye is indicated in terms of mols per mol of silver.

| | |
|---|---|
| Layer 1: An antihalation layer | |
| Black colloidal silver | 0.16 |
| UV absorbent (UV-1) | 0.20 |
| High boiling organic solvent (Oil-1) | 0.16 |
| Gelatin | 1.23 |
| Layer 2: An intermediate layer | |
| Compound (SC-1) | 0.15 |
| High boiling organic solvent (Oil-2) | 0.17 |
| Gelatin | 1.27 |
| Layer 3: A low-speed red-sensitive layer | |
| A silver iodobromide emulsion (having an average grain-size of 0.38 μm and a silver iodide content of 8.0 mol %) | 0.50 |
| A silver iodobromide emulsion (having an average grain-size of 0.27 μm and a silver iodide content of 2.0 mol %) | 0.21 |
| Sensitizing dye (SD-l) | $2.8 \times 10^{-4}$ |
| Sensitizing dye (SD-2) | $1.9 \times 10^{-4}$ |
| Sensitizing dye (SD-3) | $1.9 \times 10^{-5}$ |
| Sensitizing dye (SD-4) | $1.0 \times 10^{-4}$ |
| Cyan coupler (C-1) | 0.48 |
| Cyan coupler (C-2) | 0.14 |
| Colored cyan coupler (CC-1) | 0.021 |

| | |
|---|---|
| DIR compound (D-1) | 0.020 |
| High boiling solvent (Oil-1) | 0.53 |
| Gelatin | 1.30 |
| Layer 4: A medium-speed red-sensitive layer | |
| A silver iodobromide emulsion (having an average grain-size of 0.52 μm and a silver iodide content of 8.0 mol %) | 0.62 |
| A silver iodobromide emulsion (having an average grain-size of 0.38 μm and a silver iodide content of 8.0 mol %) | 0.27 |
| Sensitizing dye (SD-l) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| Layer 5: A high-speed red-sensitive layer | |
| A silver iodobromide emulsion (having an average grain-size of 1.0 μm and a silver iodide content of 8.0 mol %) | 1.27 |
| Sensitizing dye (SD-l) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.91 |
| Layer 6: An intermediate layer | |
| Compound (SC-1) | 0.09 |
| High boiling solvent (Oil-2) | 0.11 |
| Gelatin | 0.80 |
| Layer 7: A low-speed green-sensitive layer | |
| A silver iodobromide emulsion (having an average grain-size of 0.38 μm and a silver iodide content of 8.0 mol %) | 0.61 |
| A silver iodobromide emulsion (having an average grain-size of 0.27 μm and a silver iodide content of 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| Layer 8: A medium-speed green-sensitive layer | |
| A silver iodobromide emulsion (having an average grain-size of 0.59 μm and a silver iodide content of 8.0 mol %) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-3) | 0.002 |
| High boiling solvent (Oil-2) | 0.50 |
| Gelatin | 1.00 |
| Layer 9: A high-speed green-sensitive layer | |
| A silver iodobromide emulsion (Emulsion A) | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |
| Colored magenta coupler (CM-1) | 0.012 |
| High boiling solvent (Oil-1) | 0.27 |
| High boiling solvent (Oil-2) | 0.012 |
| Gelatin | 1.00 |

| | |
|---|---|
| Layer 10: A yellow filter layer | |
| Yellow colloidal silver | 0.08 |
| Color-stain preventive (SC-2) | 0.15 |
| Formalin scavenger (HS-1) | 0.20 |
| High boiling solvent (Oil-2) | 0.19 |
| Gelatin | 1.10 |
| Layer 11: An intermediate layer | |
| Formalin scavenger (HS-1) | 0.20 |
| Gelatin | 0.60 |
| Layer 12: A low-speed blue-sensitive layer | |
| A silver iodobromide emulsion (having an average grain-size of 0.38 μm and a silver iodide content of 8.0 mol %) | 0.22 |
| A silver iodobromide emulsion (having an average grain-size of 0.27 μm and a silver iodide content of 2.0 mol %) | 0.03 |
| Sensitizing dye (SD-8) | $4.9 \times 10^{-4}$ |
| Yellow coupler (Y-1) | 0.75 |
| DIR compound (D-1) | 0.010 |
| High boiling solvent (Oil-2) | 0.30 |
| Gelatin | 1.20 |
| Layer 13: A medium-speed blue-sensitive layer | |
| A silver iodobromide emulsion (having an average grain-size of 1.0 μm and a silver iodide content of 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| DIR compound (D-1) | 0.010 |
| High boiling solvent (Oil-2) | 0.046 |
| Gelatin | 0.47 |
| Layer 14: A high-speed blue-sensitive layer | |
| A silver iodobromide emulsion (having an average grain-size of 1.0 μm and a silver iodide content of 8.0 mol %) | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling solvent (Oil-2) | 0.046 |
| Gelatin | 0.80 |
| Layer 15: Protective layer-1 | |
| A silver iodobromide emulsion (having an average grain-size of 0.08 μm and a silver iodide content of 1.0 mol %) | 0.40 |
| UV absorbent (UV-l) | 0.065 |
| UV absorbent (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| Layer 16: Protective layer-2 | |
| Alkali-soluble matting agent (having an average particle-size of 2 μm) | 0.15 |
| Polymethyl methacrylate (having an average particle-size of 3 μm) | 0.04 |
| Lubricant (WAX-1) | 0.04 |
| Gelatin | 0.55 |

Besides the above-given compositions, coating aid Su-1, dispersing aid Su-2, a viscosity controller, layer hardeners H-1 and H-2, stabilizer ST-1, 2 kinds of antifoggants AF-1 having a weight-average molecular weight of 10,000 and AF-2 having a weight-average molecular weight of 1,100,000, and antimold DI-1 were each added. DI-1 was added in an amount of 9.4 mg/m$^2$.

The chemical structures of the compounds used in the above-mentioned samples will be shown below.

C-1
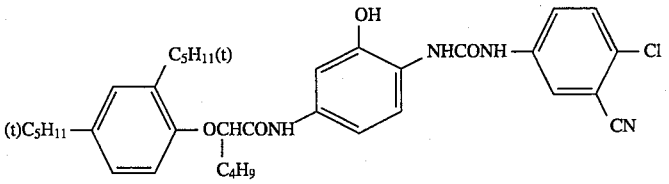
C-2
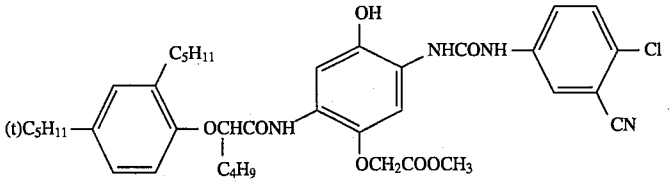
M-1
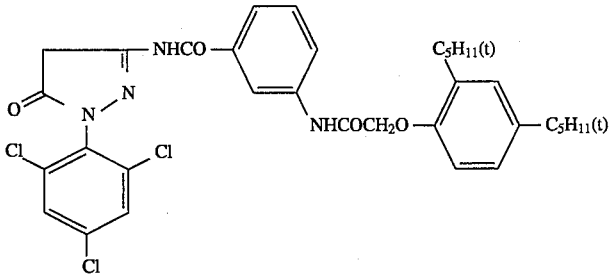
M-2
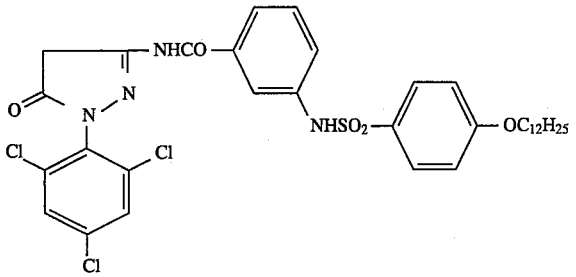
M-3
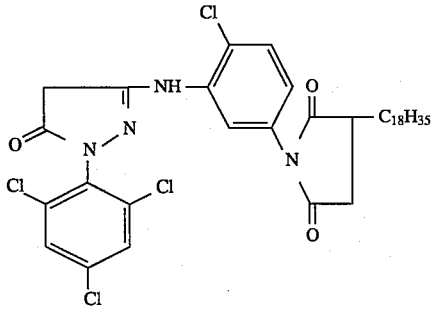
Y-1
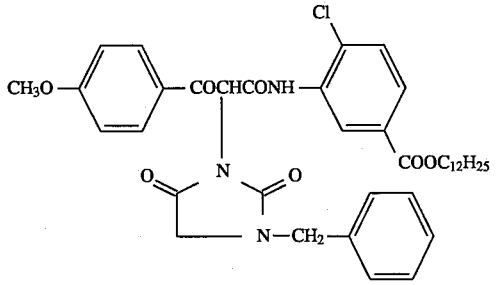

-continued
CC-1
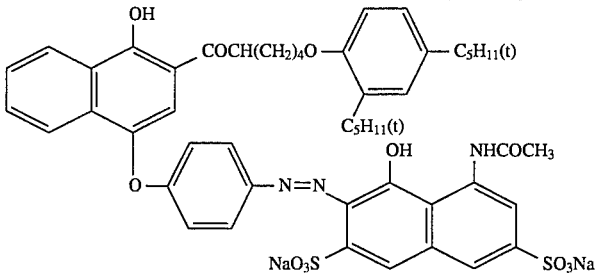
CM-1
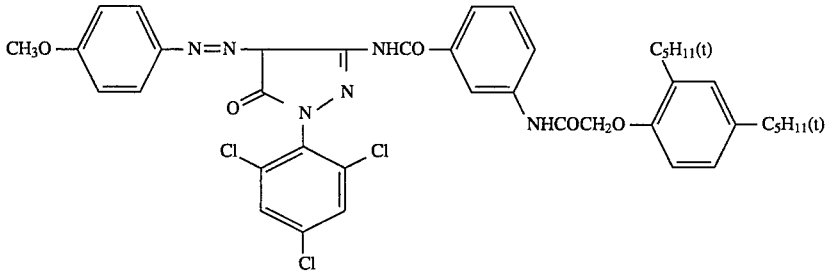
D-1
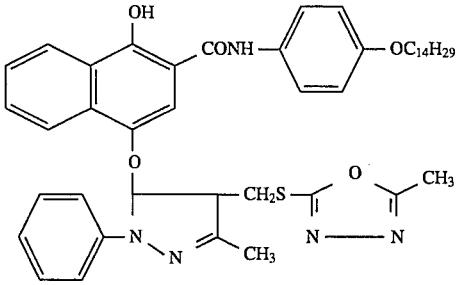
D-2
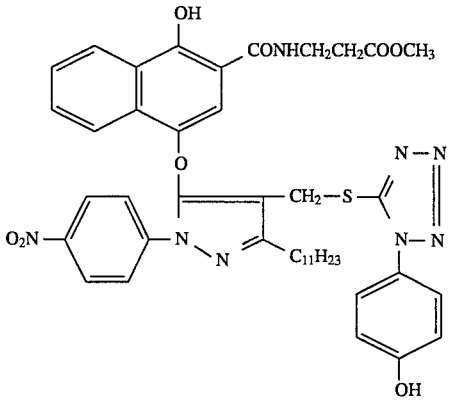
D-3
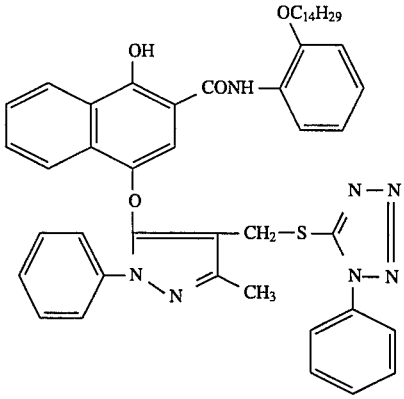

-continued
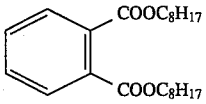
Oil-1
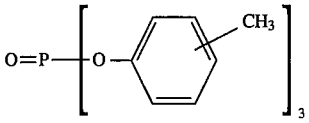
Oil-2
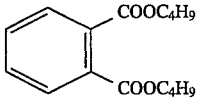
Oil-3
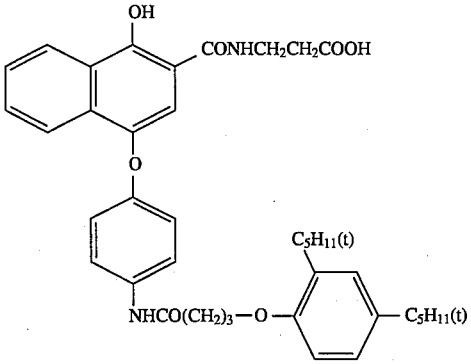
SC-1
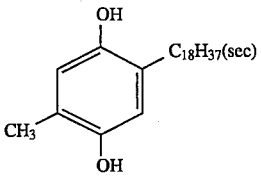
SC-2
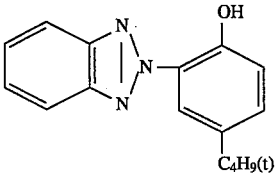
UV-1
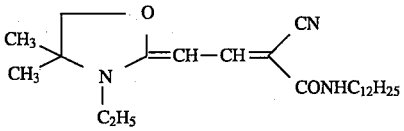
UV-2
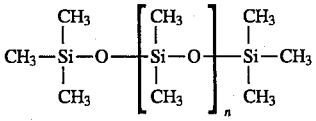
WAX-1
Weight-average molecular weight MW: 3,000
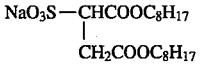
Su-1
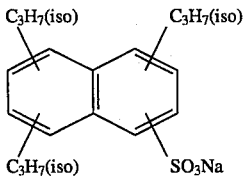
Su-2

-continued
HS-1
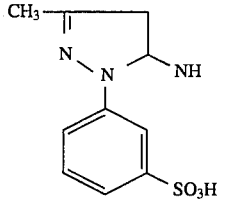
SD-1
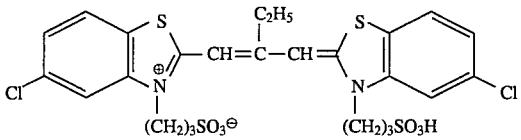
SD-2
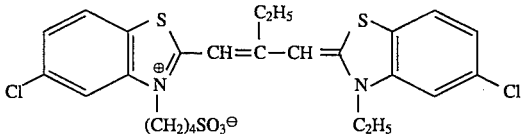
SD-3
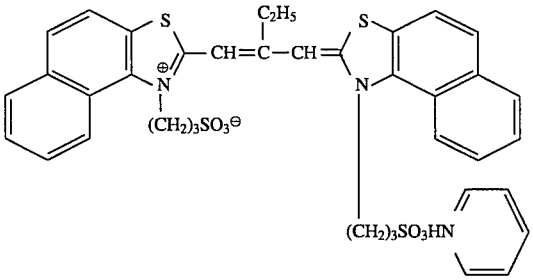
SD-4
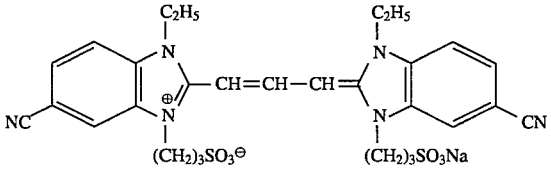
SD-5
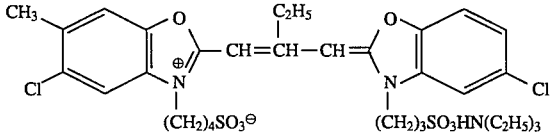
SD-6
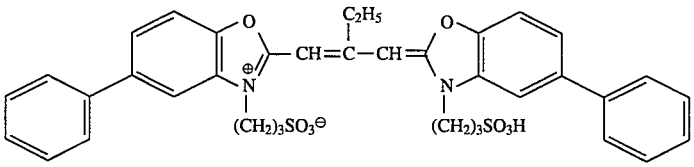
SD-7
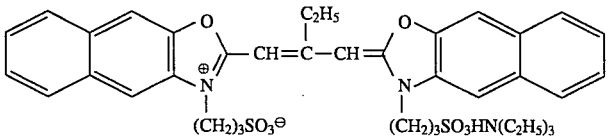
SD-8
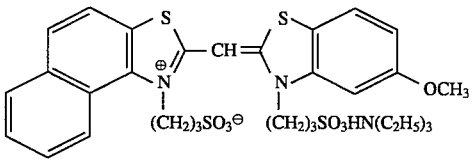

-continued

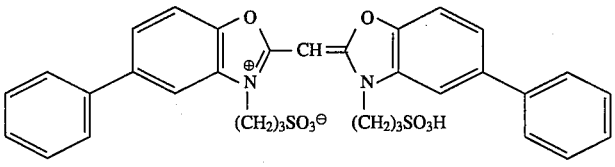

SD-9

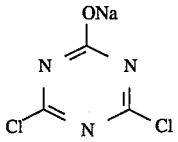

H-1

$(CH_2{=}CHSO_2CH_2)_2O$

H-2

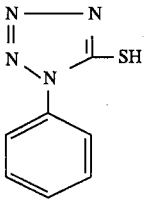

AF-1

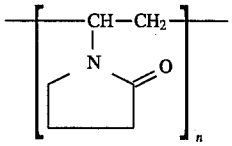

AF-2 n: Polymerization degree (A mixture of the following 3 components)

DI-1

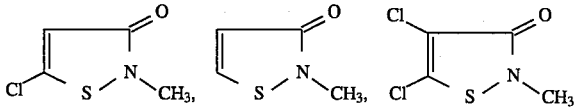

(Component A) (Component B) (Component C)

Component A:B:C = 50:46:4 (in mol ratio)

The samples were each exposed to white light for sensitometry and were then treated in the following processing steps.

| (Processing step -at 38° C.-) | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The composition of the processing solutions used in the processing steps were as follows.

| (Color developer) | |
|---|---|
| 4-amino-3-methyl-N-ethyl-N-(β-hydroxyethyl)-aniline sulfate | 4.75 g |
| Sodium sulfite, anhydride | 4.25 g |
| Hydroxylamine ½sulfate | 2.0 g |
| Potassium carbonate, anhydride | 37.5 g |
| Sodium bromide | 1.3 g |
| Trisodium nitrilotriacetate (monohydrate) | 2.5 g |
| Potassium hydroxide | 1.0 g |
| Add water to make | 1 liter |

-continued

| | |
|---|---|
| Adjust PH to be | 10.0 |
| (Bleacher) | |
| Ferric ammonium ethylenediamine tetraacetate | 100.0 g |
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | 6.0 |
| (Fixer) | |
| Ammonium thiosulfate | 175.0 g |
| Sodium sulfite, anhydride | 8.5 g |
| Sodium metasulfite | 2.3 g |
| Add water to make | 1 liter |
| Adjust pH with acetic acid to be | 6.0 |
| (Stabilizer) | |
| Formalin (in an aqueous 37% solution) | 1.5 ml |
| Konidux (produced by Konica Corp.) | 7.5 ml |
| Add water to make | 1 liter |

The relative fog, relative sensitivity and relative RMS value of the resulting fresh samples were measured by making use of green light. The results thereof will be shown in Table 4.

The term, 'a relative fog', means a relative value of the minimum density (Dmin.), and it is indicated by a value relative to the Dmin. of Sample 1 that was regarded as 100.

The term, 'a relative sensitivity', means a relative value of the reciprocal of an exposure amount capable of giving a density of Dmin.+0.15, and it is indicated by a value relative to the sensitivity of Sample 1 that was regarded as 100.

A relative RMS value was obtained in the following manner. The density of a sample was measured by scanning through a microdensitometer having a scanning aperture area of 1800 $JIm^2$ (10Jun-slit in width and 180JIm-slit in length) and provided with a Wratten filter (W-99) produced by Eastman Kodak Co so that the standard deviation of the density variations in 1,000 or more samplings was determined and the RMS values of each sample were indicated by a value relative to the RMS value obtained from Sample 1 that was regarded as being 100. It means that the smaller the RMS value is, the more the graininess is excellent.

After being allowed to stand for 5 days under the conditions of a high temperature of 50° C. and a high humidity of 80%RH, samples were each exposed to white light through a wedge and were then developed. The results of the measurements of the relative sensitivities of each sample will also be shown in Table 4, in which the sensitivities obtained are indicated by a value relative to the sensitivity value obtained from freshly prepared Sample 1 that was regarded as a value of 100.

TABLE 4

| Sample No. | Emulsion used in Layer 9 | Green-sensitive layer: Relative sensitivity Fresh | Aged | Relative fog | Relative RMS | Remarks |
|---|---|---|---|---|---|---|
| 1 | Em-1 | 100 | 70 | 100 | 100 | Control |
| 2 | Em-2 | 125 | 115 | 95 | 85 | Inventive example |
| 3 | Em-3 | 120 | 115 | 95 | 85 | Inventive example |
| 4 | Em-4 | 95 | 90 | 95 | 95 | Inventive example |
| 5 | Em-5 | 105 | 75 | 95 | 95 | Comparative example |
| 6 | Em-6 | 140 | 130 | 85 | 80 | Inventive example |
| 7 | Em-7 | 130 | 125 | 80 | 75 | Inventive example |
| 8 | Em-8 | 100 | 95 | 80 | 80 | Comparative example |
| 9 | Em-9 | 90 | 65 | 105 | 105 | Comparative example |
| 10 | Em-10 | 95 | 75 | 100 | 100 | Comparative example |
| 11 | Em-11 | 95 | 80 | 100 | 100 | Comparative example |
| 12 | Em-12 | 145 | 135 | 80 | 80 | Inventive example |
| 13 | Em-13 | 125 | 120 | 80 | 80 | Inventive example |
| 14 | Em-14 | 105 | 100 | 80 | 85 | Comparative example |

As is obvious from the contents of Table 4, it is proved that Samples 2, 3, 6, 7, 12 and 13 of the light-sensitive materials of the invention containing a silver halide emulsion of the invention are each high in sensitivity, excellent in aging stability and equivalent to or better than the comparative samples in fog and graininess.

(Example 2)

(Preparation of regular-formed seed crystal emulsion T-3)

A silver bromide emulsion was prepared by a controlled double-jet method under the conditions of 40° C., pH8.0 and pAg9.0 and the resulting emulsion was washed to remove the excessive salts. The resulting grains were shown to have an average grain-size of 0.227 μm converted into a cube and a grain-size distribution width of 12.5%.

(Preparation of emulsions EM-201S through EM-206S)

Emulsions EM-201 and EM-202 were each prepared by putting 700 ml of a gelatin solution containing 13.3 g of ossein gelatin and 0.5 ml of a 10% methanol solution of Compound I and 0.103 mols of seed emulsion (T-3) into a reaction vessel and, thereto, an aqueous solution containing 2.3 mols of silver nitrate and an aqueous solution containing 2.23 mols of potassium bromide and 0.07 mols of potassium iodide were added while stirring them violently, by a double-jet method. In the same manner as mentioned above, Emulsions EM-203 through EM206 were each prepared by making use of an aqueous solution containing 0.103 mols of seed emulsion (T-1) and 2.4 mols of silver nitrate and an aqueous solution containing 2.4 mols of potassium bromide and 0.07 mols of potassium iodide. The adding rates of each solution were varied acceleratedly so as to meet the critical growth rate of the silver halide grains. Thereby, the adding rates were suitably controlled in the course of growing the seed crystals so as neither to produce any other small grains than the growing seed crystals nor to produce any polydispersion caused by an Ostwald ripening phenomenon. Extending over the whole process of growing the crystals every time when preparing each emulsion, the pAg was optimally controlled, so that the grains having such crystal forms as shown in Table 5 (i.e., the regular crystals in EM201 and EM-202 and the tabular-shaped twinned crystals in EM203 through EM-206) could be obtained thereby. No pH was controlled therein, however, the pH was kept within the range of 5.0 to 6.0 all through the courses of growing the grains. After growing the grains, they were desalted in the manner described in JP Application No. 3-41314/1991. After that, an aqueous gelatin solution was added and dispersed at 50° C. for 30 minutes and then the pH and pBr thereof were adjusted at 40° C. to be 5.80 and 3.55, respectively. Silver halide emulsions EM-201 through EM-206, as shown in Table 5 are summarized with respect to grain-size distribution width, average grain diameter and average aspect ratio, provided that each of emulsion grains have an average grain-size of 0.65 μm converted into a cube.

TABLE 5

| Emulsion | Grain type | Grain-size distribution width (%) | Average diameter (μm) | Average aspect ratio* |
|---|---|---|---|---|
| EM-201 | Cube | 9.4 | 0.73 | 1.1 |
| EM-202 | Octahedron | 10.3 | 0.88 | 1.3 |
| EM-203 | Tabular-shaped twinned crystal | 11.7 | 0.94 | 1.5 |
| EM-204 | Tabular-shaped twinned crystal | 13.5 | 1.03 | 2.6 |
| EM-205 | Tabular-shaped twinned crystal | 17.1 | 1.16 | 4.4 |
| EM-206 | Tabular-shaped twinned crystal | 21.8 | 1.30 | 6.3 |

*Average grain diameter/average grain thickness

After adding Solution D-1 used in Example 1 to emulsions EM-201 through EM-206, the resulting mixtures were each ripened at 60° C. for 30 minutes and the optimum spectral sensitization and gold·sulfur sensitization were applied thereto by making use of SD-6 and SD-7, so that emulsions EM211S through EM-216S were obtained. To each of the emulsions, Solution D-1 was added selectively in an amount so as to have a value $I_1$ of about 8 mol % when subjected to silver halide composition analysis in the depth direction from the surface of the grains by making use of an ion-scattering spectroscopy (ISS). After applying the above-mentioned spectral/chemical sensitization to the emulsions, the values of $I_1$ and $I_2$ obtained in the ion-scattering spectroscopy will be shown in Table 6.

TABLE 6

| Emulsion | $I_1$ (mol %) | $I_2$ (mol %) | $I_1-I_2$ (mol %) | Classification |
|---|---|---|---|---|
| EM-211S | 8.1 | 6.5 | 1.6 | Comparative example |
| EM-212S | 7.8 | 6.5 | 1.5 | Comparative example |
| EM-213S | 8.2 | 6.6 | 1.6 | Invention |
| EM-214S | 8.1 | 6.7 | 1.4 | Invention |
| EM-215S | 8.1 | 6.6 | 1.5 | Invention |
| EM-216S | 8.2 | 6.8 | 1.4 | Invention |

*In the regular crystal type emulsions, the values of $D_1$ and $D_2$ each required for obtaining $I_1$ and $I_2$ were calculated out by making use of the values shown in Table 5.

The ion-scattering spectroscopic measurement was carried out in the following manner. An ESCALAB 200-R produced by VG Co. was used as an analyzer, for which $Ne^+$ was used as the excitation ion and the ion-acceleration voltage was set to be 1 KV, so that the energy range of 350 eV to 650 eV was measured. In the measurements, the area strengths at the peaks of Ag (at or about 530 eV), Br (at or about 450 eV) and I (at or about 600 eV) were obtained. From the resulting strength ratio and the sensitivity factors, the halide composition of the subject emulsions were obtained. The sensitivity factors of the emulsions were determined according to the peak strength ratio of Br to I each observed from an emulsion having a silver iodide content of 2 mol % and another emulsion having a silver iodide content of 6 mol %. On the other hand, the ion-spattering speeds were obtained by measuring an already-known thick-silver bromide vacuum-evaporated layer prepared on a mica substrate. Based upon the resulting ion-spattering speeds, the silver halide composition structures in the depth direction in the neighborhood of the surface were analyzed. For preventing a sample from being destroyed in the course of measurements, the measurements were carried out by refrigerating the subject samples to be kept at −115° C.

(Preparation of light-sensitive material samples)

A dispersion was prepared by dissolving magenta coupler (M-1) in ethyl acetate and dinonyl phthalate (DNP) and then by emulsifying and dispersing the resulting solution in an aqueous gelatin solution. The resulting dispersion and an ordinary types of photographic additives such as a spreading agent and a hardener were each added to emulsions EM-211S through EM-216S, respectively. The resulting emulsions were coated on subbed cellulose acetate supports in an ordinary manner and were then dried up, so that light-sensitive material samples No. 211S through No. 216S could be prepared, respectively.

(Preservability evaluation)

Immediately after the samples were prepared and after allowing them to stand under the same conditions of a high temperature and a high humidity as in Example 1, they were exposed to white light for sensitometry and were then processed in the same manner as in Example 1, provided that each color development process was carried out for 2 minutes 50 seconds. Of the resulting samples, the sensitivities thereof were measured by making use of green light. The sensitivities of each sample were evaluated in terms of the reciprocals of an exposure amount capable of giving a density of a fog (Dmin.)+0.15. Table 7 shows the sensitivity variation ratio of a sample aged under the conditions of a high temperature and a high humidity to a fresh sample.

TABLE 7

| Sample No. | Sensitivity variation ratio* (in %) | Remarks |
|---|---|---|
| No. 211S | 69.2 | Comparison |
| No. 212S | 67.9 | Comparison |
| No. 213S | 81.5 | Invention |
| No. 214S | 87.6 | Invention |
| No. 215S | 92.3 | Invention |
| No. 216S | 89.1 | Invention |

*A sensitivity variation ratio = a sensitivity obtained after aging the subject sample/a sensitivity obtained immediately after the subject sample was prepared.

From the results shown above, it can be seen that the light-sensitive material samples of the invention No. 213 through No. 216 each containing a silver halide emulsion of the invention were excellent in preservability.

What is claimed is:

1. A silver halide photographic emulsion comprising a dispersion medium and tabular silver halide grains having an aspect ratio of grain diameter to grain thickness of not less than 1.4, wherein said tabular grains each have a grain structure meeting the following requirement regarding an average silver iodide content in the vicinity of the grain surface, $$I_1-I_2 \geqq 1 \text{ (mol \%)}$$

wherein $I_1$ represents an average silver iodide content in mol % of a silver halide phase in a region from the grain surface to a depth of $D_1$ in Å and $I_2$ represents an average silver iodide content in mol % of a silver halide phase in a region from the grain surface to a depth of $D_2$ in Å, in which $D_1$ and $D_2$ are represented respectively by the following relations, $$D_1=1.1\times(d_0^2\pi(1/AR+½)+13.4$$

$$D_2=D_1\times 2$$

wherein $d_0$ is an average diameter of said tabular grains and AR represents an average aspect ratio of said tabular grains; and said tabular grains consist essentially of silver iodobromide having an average silver iodide content of not less than 3 mol % or a silver chloroiodobromide having an average silver iodide content of not less than 3 mol % and an average silver chloride content of not more than 10 mol %.

2. The photographic emulsion of claim 1, wherein said tabular grains account for 60% of the projected area of total grains contained in the emulsion.

3. The photographic emulsion of claim 1, wherein said tabular grains consist essentially of said silver iodobromide.

4. The photographic emulsion of claim 3, wherein said tabular grains each comprise a high iodide phase containing 8 to 45 mol % iodide in an internal portion of the grain and a lower iodide phase in an outer portion thereof.

5. The photographic emulsion of claim 1, wherein said tabular grains have an aspect ratio of 1.4 to 15.

6. The photographic emulsion of claim 1, wherein not less than 60% of the total number of said tabular grains contained in the emulsion are said tabular grains which have two parallel twin planes.

7. The photographic emulsion of claim 6 wherein not less than 70% of the total number of said tabular grains contained in the emulsion are said tabular grains which have two parallel twin planes.

8. The photographic emulsion of claim 1, wherein said tabular grains consist essentially of said silver chloroiodobromide.

9. The photographic emulsion of claim 1, wherein not less than 80% of the total number of said tabular grains contained in the emulsion are said tabular grains which have two parallel twin planes.

10. A silver halide photographic light sensitive material comprising a support having thereon a silver halide emulsion layer, wherein said silver halide emulsion layer comprises a silver halide emulsion containing tabular silver halide grains having an aspect ratio of grain diameter to grain thickness of not less than 1.4, said tabular grains having a grain structure meeting the following requirement regarding an average silver iodide content in the vicinity of the grain surface, $$I_1-I_2 \leqq 1 \text{ (mol \%)}$$

wherein $I_1$ represents an average silver iodide content in mol % of a silver halide phase in a region from the grain surface to a depth of $D_1$ in Å and $I_2$ represents an average silver iodide content in mol % of a silver halide phase in a region from the grain surface to a depth of $D_2$ in Å, in which $D_1$ and $D_2$ are represented by the following relations, $$D_1=1.1\times[d_0^2\pi(1/AR+½)]+13.4$$

$$D_2\times D_1\times 2$$

wherein $d_O$ is an average diameter of said tabular grains and AR represents an average aspect ratio of said tabular grains and said tabular grains consist essentially of silver iodobromide having an average silver iodide content of not less than 3 mol % or a silver chloroiodobromide having an average silver iodide content of not less than 3 mol % and an average silver chloride content of not more than 10 mol %.

* * * * *